US008091488B2

(12) United States Patent
Chirea et al.

(10) Patent No.: US 8,091,488 B2
(45) Date of Patent: Jan. 10, 2012

(54) FLIP TOP MECHANISM FOR TABLE WITH NESTING CAPABILITIES

(75) Inventors: Lucian Chirea, St. Louis, MO (US); Robert Harrell, Warrenton, MO (US); William Laclede, St. Louis, MO (US)

(73) Assignee: Berco Industries, Inc., St. Louis, MO (US)

( * ) Notice: Subject to any disclaimer, the term of this patent is extended or adjusted under 35 U.S.C. 154(b) by 488 days.

(21) Appl. No.: 12/290,837

(22) Filed: Nov. 4, 2008

(65) Prior Publication Data

US 2009/0114130 A1 May 7, 2009

Related U.S. Application Data

(60) Provisional application No. 61/002,248, filed on Nov. 7, 2007.

(51) Int. Cl.
*A47B 3/00* (2006.01)

(52) U.S. Cl. ..... 108/115; 108/91

(58) Field of Classification Search ..... 108/115, 108/6, 155, 91, 189; 248/188.1; 16/324
See application file for complete search history.

(56) References Cited

U.S. PATENT DOCUMENTS

| | | | | |
|---|---|---|---|---|
| 2,016,363 | A * | 10/1935 | Culotti | 108/124 |
| 5,109,778 | A | 5/1992 | Berkowitz et al. | |
| 5,121,697 | A | 6/1992 | Baum et al. | |
| 5,182,996 | A * | 2/1993 | Gutgsell | 108/64 |
| 5,337,657 | A * | 8/1994 | Diffrient | 108/115 |
| 5,638,761 | A | 6/1997 | Berkowitz et al. | |
| 6,845,723 | B2 * | 1/2005 | Kottman et al. | 108/132 |
| 7,066,098 | B2 * | 6/2006 | Blasen et al. | 108/115 |
| 2008/0017082 | A1 * | 1/2008 | Bue | 108/115 |

* cited by examiner

*Primary Examiner* — Janet M Wilkens
(74) *Attorney, Agent, or Firm* — Paul M. Denk

(57) ABSTRACT

A table top with a flip mechanism has a frame of two spaced apart legs, each leg having two pivoting wheels, a spine connecting each leg, and a table top hingedly connecting to the spine for rotation off the center of the table. The spine and table top extend upon the longitudinal axis of the table. The spine has generally two parallel spaced apart members. The table top hingedly connects to one member and rests upon the other member when the table top is flat. Lifting the table from a longitudinal edge opposite the hinges, the table top pivots upon the hinges and rotates about the spine until upright. The upright table is then parallel to the legs and occupies a minimum footprint. Alternatively, the legs have wheels for easy movement of the table.

8 Claims, 4 Drawing Sheets

FLIP TOP MECHANISM FOR TABLE WITH NESTING CAPABILITIES

CROSS-REFERENCE TO RELATED APPLICATIONS

This non-provisional patent application claims priority to the provisional patent application having Ser. No. 61/002,248, which was filed on Nov. 7, 2007.

BACKGROUND OF THE INVENTION

The flip top mechanism for table with nesting capabilities generally relates to portable furniture and more specifically to a top that folds upward axially for nesting of the frame and top of one table with adjacent tables.

After obtaining a chair, people often seek a table upon which to perform various tasks. A table provides a flat surface upon which a person performs a task. The flat surface acts as a component of a top spaced above a floor by a frame. The top spaced above allows a seated person to move the legs of the person below the table; thus, the person sits close to the edge of the table.

At the table, people do various things and acts. People eat, read, write, converse, entertain, operate equipment and tools, and do a host of other things around and upon tables. Tables are also used outdoors and indoors. Indoor table usage spans from residential service through retail to commercial and even industrial applications. Indoor tables occupy basements, dining rooms, living rooms, offices, classrooms, ballrooms, libraries, cafeterias, and other open spaces for groups of people. From time to time, tables have to be moved.

Initially a person, or more likely two people, can lift a table and move it to a new location. Often, the new location for a table includes a storage position for placement in a closet or a room. People store tables by placing them on end or one tabletop upon another. These storage methods, though, do not lend themselves to storing more than a handful of tables, as they consume space and use space inefficiently.

DESCRIPTION OF THE PRIOR ART

Seeking efficient table storage, not to mention portability, folding tables have become popular. Folding tables have various forms including portable tables where pairs of legs fold beneath the table, card tables where the individual legs fold into the perimeter of the table, field tables where legs upon a hinged board fold beneath a planar top, and cafeteria tables. Cafeteria tables come in various forms as well that generally seat groups of people exceeding four and may have integral seating. Cafeterias, though, often see multiple uses, particularly in schools. Cafeteria tables generally have a design to permit folding and compact storage of multiple tables. The tables, legs, and seats of a cafeteria table generally fold upwardly into a minimum square footage footprint. The legs often include wheels or rollers to aid movement and positioning of the cafeteria table into and out of storage.

The tabletops of cafeteria tables generally have at least one joint transverse that permits folding into at least two parts. The tabletop has a frame below for support when unfolded and that pivots into sections when the table folds. The seats attach to members that pivot upon sections connected to the legs of the table. Then the legs pivot upwardly turning the sections of seats vertical along with the parts of the tabletop. The folded cafeteria table occupies much less footprint than when unfolded and a minimum footprint for movement and storage of the folded table. However, the folded cafeteria table with its seats and frame sections nests poorly with adjacent tables though space remains within the frame sections.

As school cafeterias serve multiple functions, the cafeteria table may move in and out of storage regularly. Moving a cafeteria table generally calls for wheels upon the frame of the table for movement when folded. Some models of cafeteria cafeteria tables have lockable wheels for movement of an unfolded table. The wheels minimize the labor required in moving the tables and, thus, permit timely changes of tables for the various activities in a school cafeteria.

Folding tables are also used in offices and work areas. The folding tables generally have a tabletop of various lengths reinforced with a perimeter frame below the tabletop. Two frames of legs then connect in a hinged manner to the underside of the table. A folding diagonal strut upon each leg frame maintains the legs upright when the strut locks with a sliding ring. The struts in cooperation with the legs prevent racking of the legs and provide a stable support for the top while allowing a person to sit beneath the table. For moving the folding table, the sliding rings are moved and the struts are bent so that the legs can fold within the frame beneath the table. One or two persons then lift the table and move it to a desired location. Often the persons carry the table on edge for easier passage through doors. For longer distances and less strong persons, carrying a folding table proves tiring.

The present invention overcomes the disadvantages of the prior art and provides a table top with a flip mechanism upon a wheeled frame that nests with adjacent tables. The table top rotates about its longitudinal axis alongside the legs of the invention minimizing the footprint of the table.

SUMMARY OF THE INVENTION

Generally, the present invention of a flip top mechanism for table with nesting capabilities has a frame with two spaced apart legs, each leg having two pivoting wheels, a spine connecting each leg, and a table top hingedly connecting to the spine. The spine and table top extend upon the longitudinal axis of the invention. The spine has generally two parallel spaced apart members. The table top hingedly connects to one member and rests upon the other member when the other member when the table top is flat, or horizontal. Lifting the table from a longitudinal edge opposite the hinges, the table top pivots upon the hinges and rotates about the spine until upright, or vertical. The upright table is then parallel to the legs and occupies a minimum footprint.

There has thus been outlined, rather broadly, the more important features of the invention in order that the detailed description thereof that follows may be better understood and that the present contribution to the art may be better appreciated. The present invention also includes legs having two members upon an arcuate foot securing to the wheels, locking pins in the spine member opposite the hinges, locking mechanisms that readily engage the locking pins with an elongated member, hinges that clamp upon the spine member, the table top rotating off center, the tabletop being spaced above the spine members by the hinges, and a shoulder joint fixedly connecting the legs to the spine generally perpendicularly. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the flip top mechanism for table with nesting capabilities is to provide a flip top table that occupies a square footage footprint less than the width of the tabletop when the tabletop is in the upright position.

Another object of the flip top mechanism for table with nesting capabilities is to provide a flip top table that rotates off the centerline of the invention.

Another object of the flip top mechanism for table with nesting capabilities is to provide a flip top table that has a manual locking mechanism between the tabletop and the frame.

Another object of the flip top mechanism for table with nesting capabilities is to provide a flip top table that has the tabletop spaced above the frame when in the down position.

Another object of the flip top mechanism for table with nesting capabilities is to provide a flip top table that has a low cost of manufacturing so the consuming public can readily purchase the invention and its component parts through existing retail outlets.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
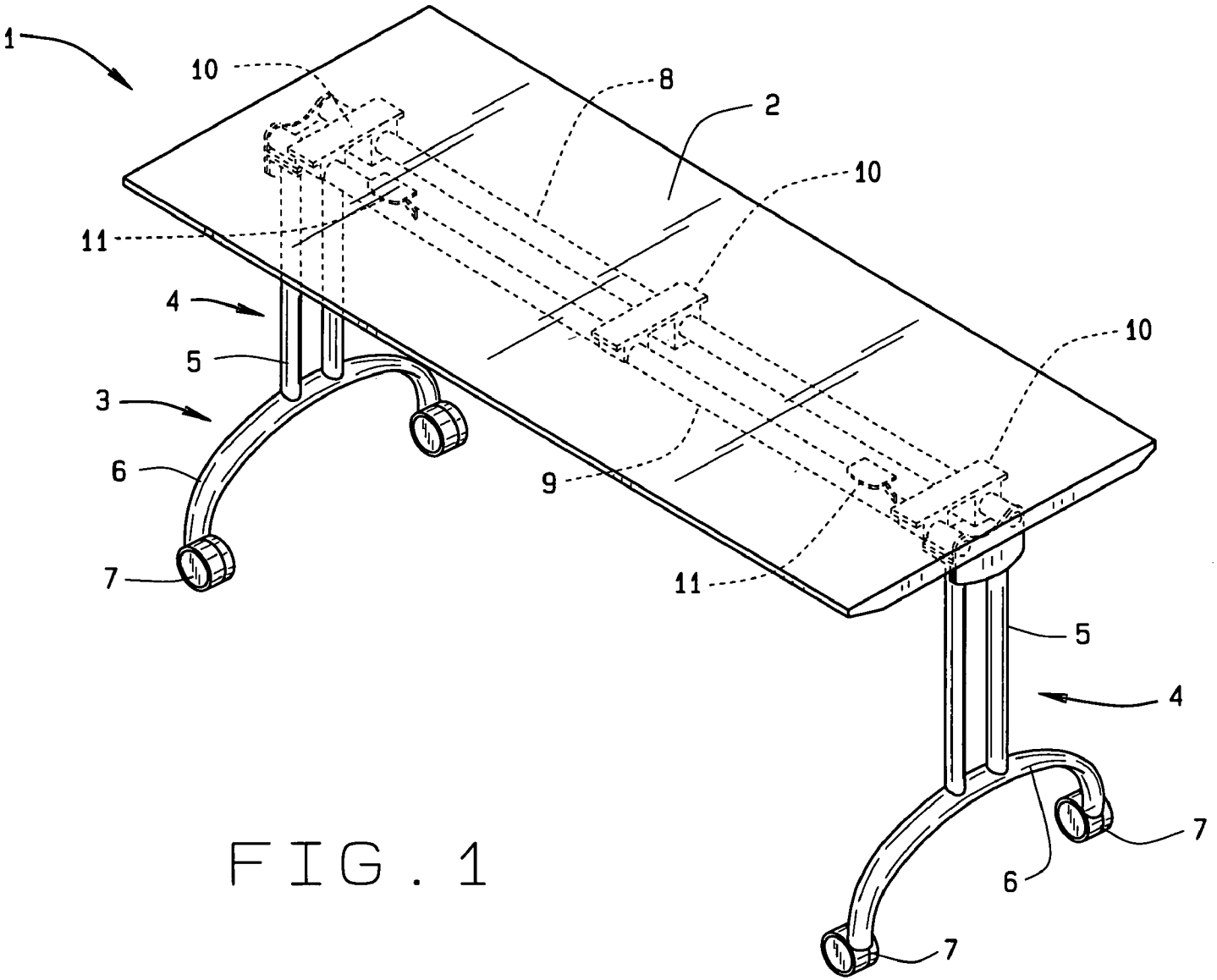
FIG. 1 shows a perspective view of the present invention with the tabletop in the down position.

The present invention overcomes the prior art limitations by providing a flip top mechanism for table with nesting capabilities that rotates a tabletop upright, parallel to its length and off center thus occupying a smaller footprint, in square footage, than the tabletop itself allowing for compact storage of this table and nesting of multiple tables. The table 1 takes form in FIG. 1, where a tabletop 2 attaches to a frame 3 that spaces the tabletop above the ground at a comfortable distance, generally 29 inches. The tabletop is generally rectangular and has a length that greatly exceeds its width. Though a rectangular table is preferred, alternate shapes are possible provided half of the width of an alternate shape is less than the height of the tabletop above the ground. Alternate shapes may include oval, ovoid, round, square, and hexagonal among others.

With the tabletop attaching to a frame, the frame has two spaced apart leg assemblies 4. The leg assemblies are mutually parallel and generally perpendicular to the ground, or surface, supporting the table and to the tabletop. In the preferred embodiment, each leg assembly has two parallel legs 5 that attach to attach to a foot 6 that extends outwardly from the ends of the legs opposite the tabletop. Each foot has an arcuate shape, here shown as convex, with the legs joining at the center and upper portion of the foot. Each foot has two ends outwardly from the legs and each end has a caster 7, here shown as lockable Simpson type. The frame 3 connects each leg assembly 4 upon the spines 8, 9 here shown in phantom. The tabletop connects to the spines in a pivotal manner upon preferably three hinges 10 with two locking mechanisms 11 all shown in phantom.

Figure 2:
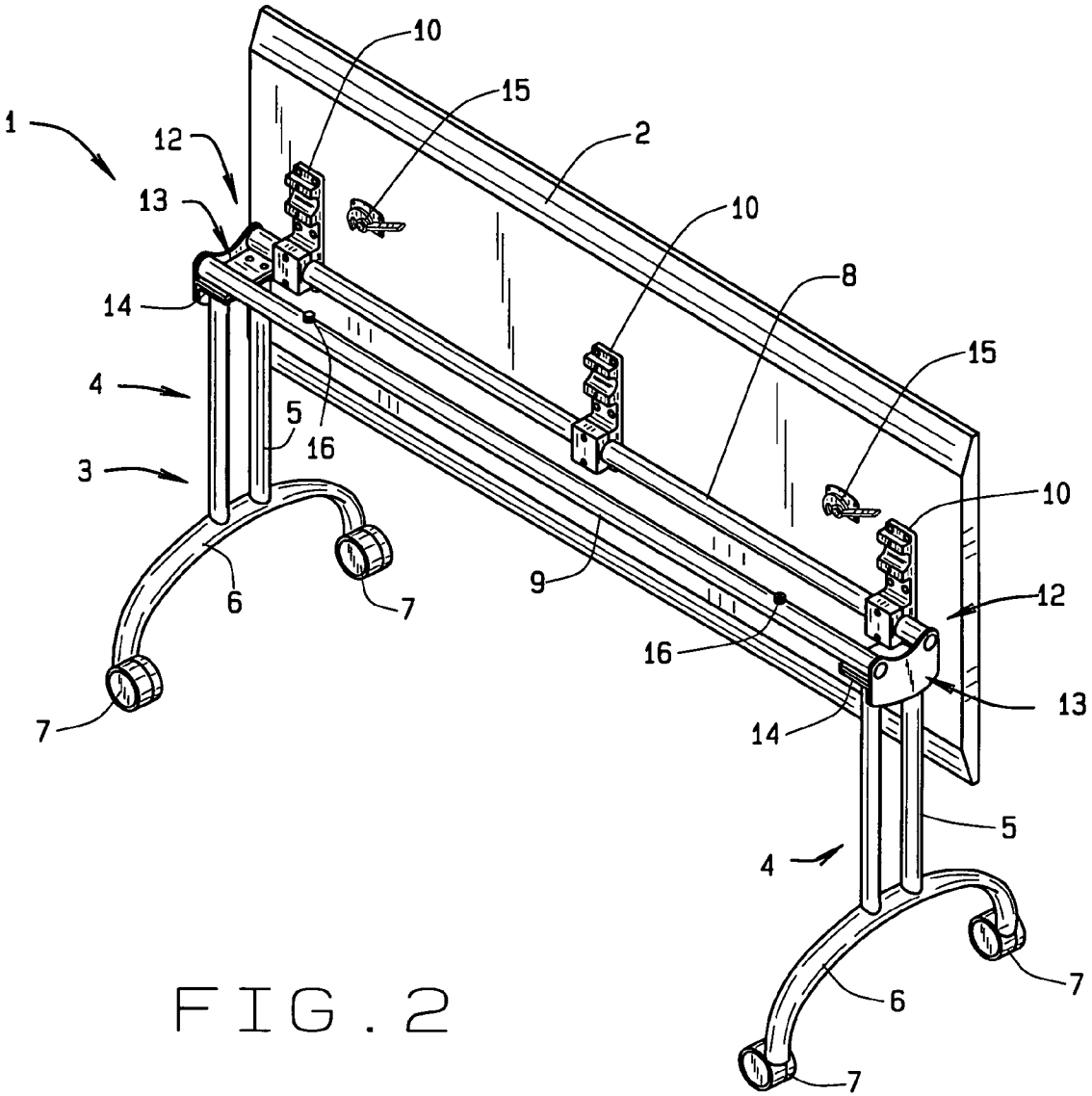
FIG. 2 describes a perspective view of the present invention where the tabletop is in the upright position and shows the mechanisms beneath the tabletop.

Pivoting the tabletop 2 upwardly, the present invention 1 reveals more of the frame 3 in FIG. 2. The frame includes two spines, an outer spine 8 and a mutually parallel inner spine 9. The outer spine and the inner spine each have two opposite ends and each end connects to a leg assembly 4 in a rigid, moment resistant connection similar to a shoulder 12. Each shoulder has a blade 13, generally planar and securing to the ends of an outer spine and an inner spine flush with the top of both spines. The blade extends downwardly, away from the table and connects to a bracket 14. The bracket has a generally L shape with a web 14*a* perpendicular to a flange 14*b*. The blade 13 secures to the web 14*a*, as later shown in FIG. 3, and both the blade and the web are perpendicular to the tabletop. The flange 14*b* of the bracket then connects to the ends of the legs 5 opposite the foot. In the preferred embodiment, the shoulder is bolted together with the bracket bolting to the legs, the bracket bolting to the plate, and the spines bolting to the plate. The bracket and plate resist moments and shear forces transmitted by the spines when a large load is placed upon the center of the table, such as a person standing upon the table to reach a ceiling and like elevated activities.

FIG. 2 shows the present invention 1 with the tabletop 2 upright, or in the raised, or up, position. The tabletop attains this position by pivoting upon the three three hinges 10 that rotate upon the outer spine 8. The outer spine is located outward from a person sitting at the table. Each hinge rotates upon the outer surface of the outer spine but does not mechanically connect through the spine. The hinges include one at the center of the table 1 and one proximate each leg assembly 4. Inward from the hinges 10 near the leg assemblies 4, the tabletop has a locking mechanism with a female part 15 and a male part 16. The male part extends from the inner spine, generally closer to a person seated at the table, and towards the tabletop 2.

Figure 3:
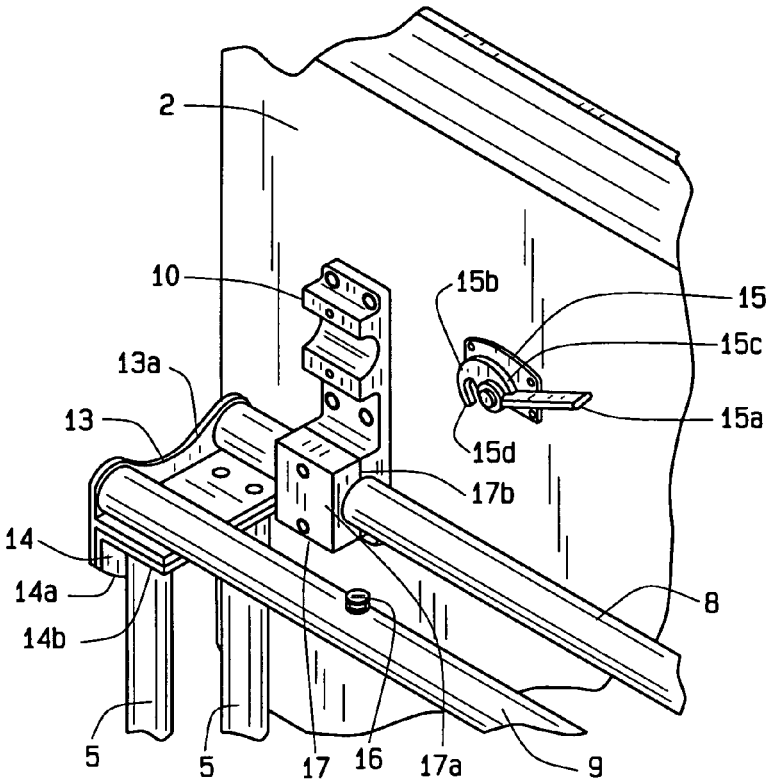
FIG. 3 is a detail view of the shoulder, hinge, and lock mechanism of the present invention.

In the preferred embodiment as more clearly shown in FIG. 3, the male part is a pin, generally round with a perimeter groove 16*a*. The female part has a handle 15*a* extending from a rounded claw 15*b* having two ends. One end 15*c* is integral with the handle and the other end is free, as at 15*d*. The integral end is pivotally connected to the tabletop generally opposite the top surface of the tabletop. In usage of the lock mechanism, the tabletop is folded down upon the spines and the handle is turned counterclockwise which engages the claw with a cooperating pin. The claw generally inserts within the groove of the pin to prevent inadvertent lifting or tipping of the tabletop 2.

Proximate the female lock, a hinge block 10 secures to the bottom surface of the tabletop 2 and clamps upon the outer spine 8. The clamping action occurs by a cover 17 placed upon half of the perimeter of the outer spine and that then secures to a portion of the hinge block. The cover has a generally rectangular shape with a lower planar surface 17*a* and an opposite upper surface 17*b*. The upper surface has a half channel 17*c*, centered and transverse, that has a similar diameter to that of the outer spine. The diameter of the half channel is less than the thickness of the cover. Upon the lower surface and outwardly of the footprint of the half channel at least two bolts secure the cover to the hinge block.

FIG. 3 also shows the shoulder connection of the spines 8, 9 to the leg assembly on each end of the invention 1. Upon each leg 5 on the end opposite the foot 6, a bracket 14 fixes the legs mutually parallel and spaced apart. The bracket has a web 14*b* that spans the ends of the legs and slightly beyond the legs. The web has a generally planar rectangular shape and generally bolts to the ends of the legs but welding is an alternate means of connection. The web has an integral flange 14*a* upon one longitudinal edge, generally outwardly of the legs. The flange extends down towards the foot, at least the diameter of the legs. The flange has a generally rectangular shape. Outwardly from the flange, the blade 13 secures to the flange and above the web. The blade has a somewhat rectangular shape that extends from the lower perimeter of the web upwardly over the ends of the spines. In the preferred embodiment, the blade has a concave edge 13*a* that extends from end to end of each spine. Generally, the blade bolts to the ends of the spines through threaded holes in the ends of the spines.

Figure 4:
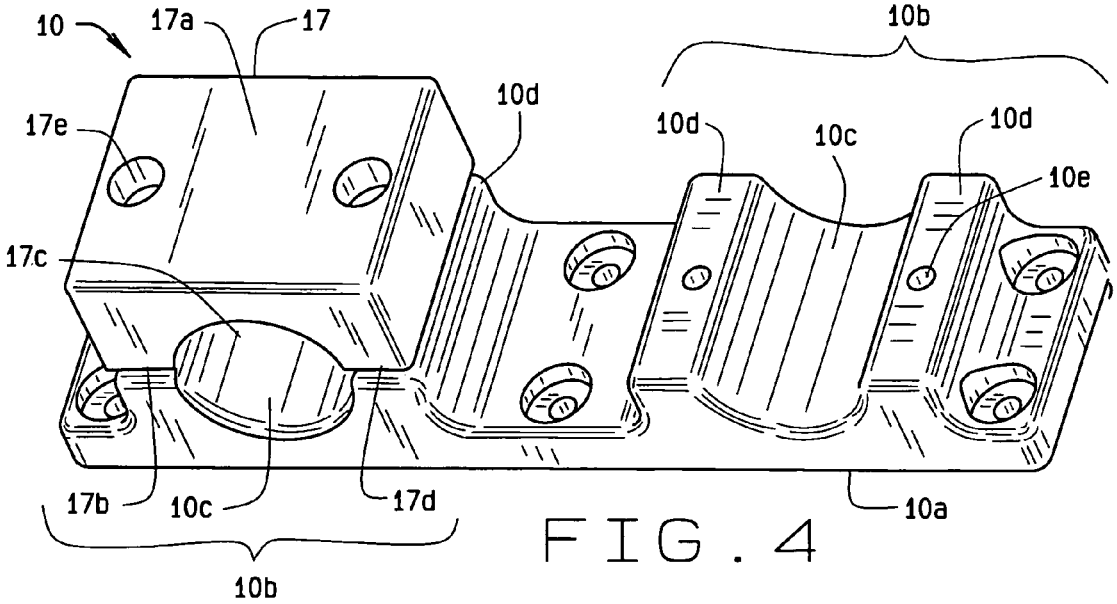
FIG. 4 describes a perspective view of the hinge mechanism of the present invention; and, FIG. 5 shows the flip top tables having nesting capabilities.

Looking more closely at the hinge block, FIG. 4 shows the device that allows the table the flip top feature. The hinge block 10 is generally symmetric, has a flat bottom surface 10*a* for attachment to the bottom surface of the tabletop, and two similar halves 10*b* opposite the bottom surface. Each half has a half channel 10*c* formed between two mutually parallel and spaced apart rims 10*d*. The rims extend upwardly from the hinge block opposite the bottom surface 10*a*. The height of each rim raises the bottom of the half channel 10*c* away from the bottom surface 10*a* a sufficient distance, or thickness, to resist the shear and rotational forces endured by the hinge block during usage. In the preferred embodiment, the height of the rim from the bottom surface exceeds the radius of the half channel. Generally centered in each rim, an aperture 10*e* receives the bolts that attach the cover 17.

As before, the cover is generally rectangular with a lower surface 17*a*, generally disposed below the spines when installed and the table is lowered. The lower surface has two countersunk bores 17*e* for bolts that connect with the apertures 10*e* in two rims. Opposite the lower surface, the cover has an upper surface 17*b* having two mutually parallel rims 17*d* that align with the rims upon the hinge block. The upper surface also has a half channel 17*c* with a diameter similar to that of the half channel 10*a* in the hinge block and similar to the diameter of the spines. In the preferred embodiment, the half channels of the hinge block, cover, and the diameters of the spines are similar. In an alternate embodiment, one half channel of the hinge block, the half channel of the cover, and the outer spine have a common diameter while the other half channel of the hinge block has a different diameter. The cover and one of the half channels on the hinge block cooperate to grasp the entire circumference of the outer spine while the smooth surface of the half channel allows the tabletop to pivot, or flip, between a down, or lowered, position (FIG. 1), and an up, or raised, position (FIG. 2).

Figure 5:
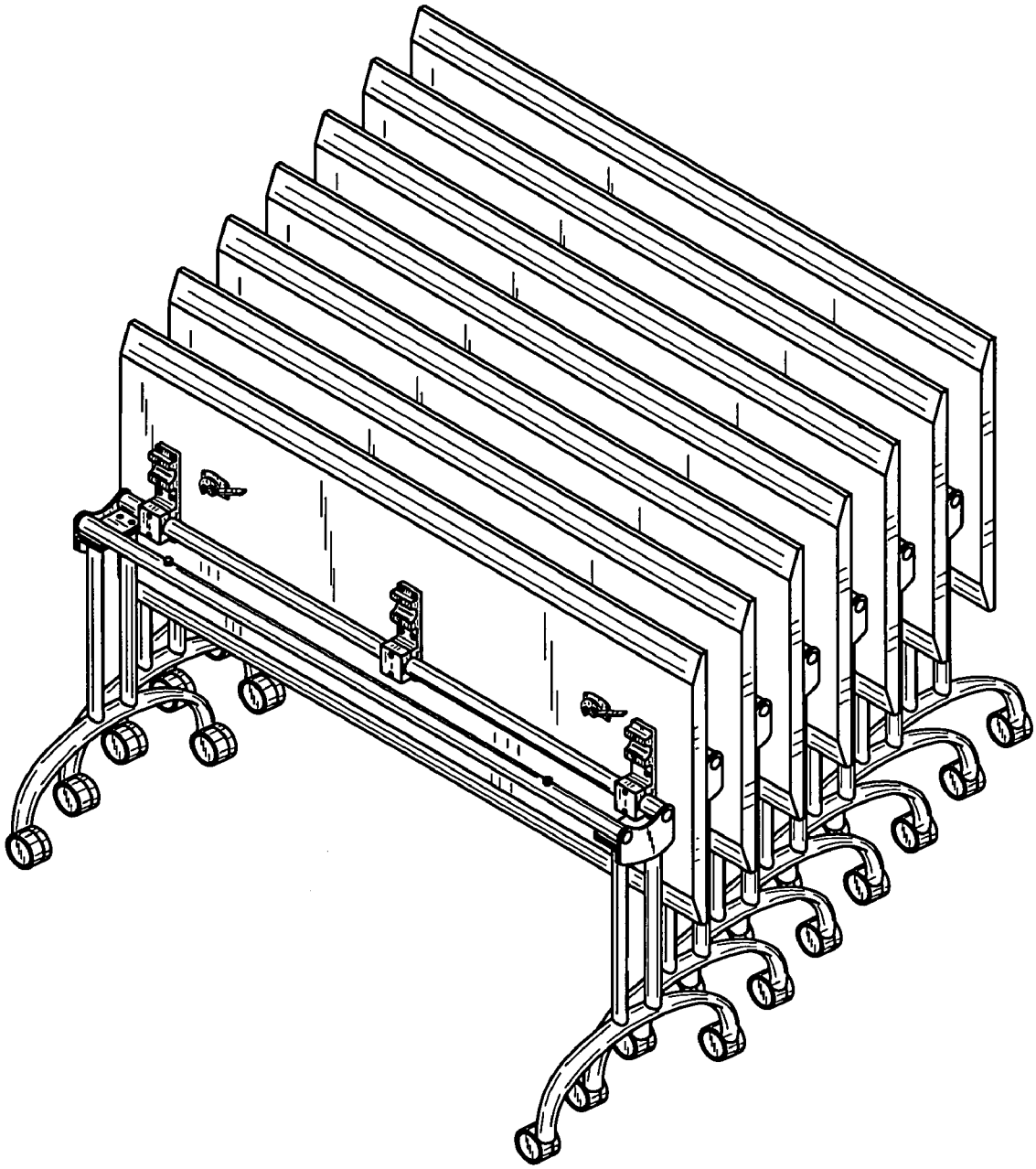

FIG. 5 shows how the flip top mechanism incorporated into the tables of this invention provide a table that affords nesting capabilities. As can be seen, a whole series of the tables, since their tops are folded into a vertical configuration, can be layered together, in a nested configuration, as noted.

From the aforementioned description, a flip top mechanism for table with nesting capabilities has been described. The table with a flip top is uniquely capable of pivoting upward upon hinges with an axis of rotation off the centerline of the table and temporarily securing the table in the lowered position using a claw and pin lock. The table has a generally tubular frame with two-wheeled leg assemblies at each end of the table. The table and its various components may be manufactured from many materials, including but not limited to, wood, engineered lumber, steel, aluminum, polymers, ABS plastic, polyvinyl chloride, high density high density polyethylene, polypropylene, nylon, rubber, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Heretofore, those skilled in the art have not recognized tapered ends as suitable for connections of adjacent parts in ductwork. Therefore, the claims include such equivalent constructions insofar as they do not depart from the spirit and the scope of the present invention.

We claim:

1. A table, comprising:

a frame having two spaced apart leg assemblies and at least one spine connecting said leg assemblies, said leg assemblies defining a centerline of said table;

a tabletop, generally planar in shape and having a longitudinal axis, hingedly connecting to said at least one spine, wherein said tabletop rotates about its longitudinal axis mutually parallel and spaced apart from the centerline of said table from a lowered position to a raised position, said lowered position orienting said tabletop horizontal, said raised position orienting said tabletop vertical occupying minimal surface area, and the plane of said tabletop being parallel to said leg assemblies when in said raised position;

said at least one spine comprising an outer spine, and a mutually parallel spaced apart inner spine, said inner and outer spines extending approximately the length of said tabletop and connecting with the respective leg assemblies;

said table having at lest two hinges, said hinges connecting to said outer spine, and said hinges temporarily securing said table top in the lowered position;

said hinges including a block connecting to a bottom surface of said tabletop and a cooperating cover connecting a portion of said hinge, said cover and said block encircling said outer spine;

said table top having at least two locks, each lock having a female part upon the bottom surface of said tabletop and a cooperating male part upon said inner spine wherein said locks temporarily retain said table top in the lowered position and prevent accidental tipping of said tabletop; and whereby said tabletop may be pivoted between its said lowered position to said raised position, as during temporary storage.

2. The table of claim 1 further comprising:

each of said blocks having two halves, each half having a half channel formed between two mutually parallel and spaced apart rims, said half channel having a similar diameter as said outer spine;

each of said covers having two mutually parallel and spaced apart rims defining a half channel having a similar diameter as said outer spine; and, said blocks and said covers having sufficient thickness below said half channels for rigidity.

3. The table of 1 further comprising:

said female part having a handle pivotally connecting to the bottom surface of said tabletop and a claw extending from said handle; and, said male part having a pin wherein said claw grasps said pin retaining said tabletop in said lowered position.

4. The table of claim 3 further comprising:

said pin having a circumferential groove capable of engaging said claw.

5. The table of claim 1 further comprising:

each of said leg assemblies having two mutually parallel spaced apart legs, said legs being generally perpendicular to said spine, and a foot generally perpendicular to said legs and extending outwardly of said legs.

6. The table of claim 5 wherein said foot has at least one caster.

7. The table of claim 5 wherein each foot of the leg assembles is linearly disposed perpendicularly at the lower end of said legs.

8. The table of claim 5 wherein each foot at the lower end of each leg being accurately shaped.

* * * * *